US005425665A

United States Patent [19]

Kennedy

[11] Patent Number: 5,425,665

[45] Date of Patent: Jun. 20, 1995

[54] OPTICAL LENS BLOCKER AND METHOD

[75] Inventor: Brian H. Kennedy, Charlottesville, Va.

[73] Assignee: National Optronics, Inc., Charlottesville, Va.

[21] Appl. No.: 987,753

[22] Filed: Dec. 9, 1992

[51] Int. Cl.[6] ..... B24B 13/06

[52] U.S. Cl. ..... 451/5; 451/460; 451/390

[58] Field of Search ..... 51/165.72, 165.71, 277, 51/284 E, 284 R, 216 LP; 451/6, 5, 460, 43, 42, 390

[56] References Cited

U.S. PATENT DOCUMENTS

| | | | |
|---|---|---|---|
| 2,734,322 | 2/1956 | Vaughan | 51/277 |
| 3,277,612 | 10/1966 | Brandt | 51/277 |
| 3,586,448 | 6/1971 | Beasse | 356/172 |
| 4,288,946 | 9/1981 | Bicskei | 51/284 E |
| 4,330,203 | 5/1982 | Oppenheim et al. | 51/216 LP |
| 4,543,752 | 10/1985 | Kötting | 51/277 |
| 4,656,590 | 4/1987 | Ace | 364/474 |
| 4,737,918 | 4/1988 | Langlois et al. | 364/474 |
| 4,936,056 | 6/1990 | Gaudel et al. | 51/277 |
| 5,070,657 | 12/1991 | Brule et al. | 51/277 |
| 5,263,285 | 11/1993 | Langlois et al. | 51/277 |
| 5,283,980 | 2/1994 | Lohrenz et al. | 51/165.72 |

FOREIGN PATENT DOCUMENTS

| | | | |
|---|---|---|---|
| 0206860 | 5/1986 | European Pat. Off. . | |
| 0409760 | 7/1990 | European Pat. Off. . | |
| 2676383 | 5/1991 | France . | |
| 3316619 | 11/1984 | Germany . | |
| 3829488 | 3/1990 | Germany . | |
| 4208271 | 9/1992 | Germany | 51/165.72 |
| 60-259365 | 12/1985 | Japan . | |

*Primary Examiner*—Robert A. Rose
*Attorney, Agent, or Firm*—Berenato, III: Joseph W.

[57] ABSTRACT

A lens blocker assembly has a first support table moveable in a first direction. A second support is carried by the first support and is moveable in a second direction, with the second direction being angularly disposed relative to the first direction. Variable output drives are operably associated with the supports for selectively moving the supports in the associated directions. A lens block applicator is operably associated with the second support for applying a lens block to a lens blank disposed on the second support.

28 Claims, 4 Drawing Sheets

OPTICAL LENS BLOCKER AND METHOD

FIELD OF THE INVENTION

The disclosed invention is a machine and method for moving an optical lens blank relative to a lens block applicator for assuring that the lens block is properly positioned relative to the geometric and the optical centers of the resulting lens.

BACKGROUND OF THE INVENTION

Optical lenses are typically produced from circular lens blanks which have a known front surface curvature, a known index of refraction, and a known diameter. The curvature of the back surface may be known, or it may be generated by various cutting assemblies known in the art. Once the appropriate back surface has either been selected or generated, then there is a further need to cut or edge the lens to match the shape of the frame into which the lens is to be placed.

A pair of eyeglasses has two edged lenses, each of which may have optical requirements unique to itself. The prescription written by the optician specifies the optical characteristics which each lens is to achieve upon being manufactured. The optician does not normally know the peripheral shape of the lens, and the lens maker must take the peripheral shape and other information into account when manufacturing the lens. It is required that the optical center of the lens be aligned with the pupil of the wearer, in order for the wearer to obtain the benefit of the eyeglasses. The optical center is that point where the prescription-derived optical characteristics are achieved, and the optical center should thus be aligned with the pupil of the eye. Modern eyeglasses, however, have lens shapes of a wide degree of variability, and it is unusual for the optical center of the lens to be aligned with the geometric center of the frame shape. The geometric center is that point where the horizontal distance (A) intersects the vertical distance (B) when the lens is boxed, i.e. placed within a square, as shown in FIG. 9, about the resulting lens. The geometric center may be both vertically and horizontally offset relative to the optical center.

Conventional edging technology calls for the lens to be rotated about its frame geometric center as the edging or grinding process proceeds. Because the optical center is not aligned with the geometric center, then it is important that the displacements therewith be taken into account when the lens is prepared for edging. If those displacements are not taken into account, then the optical center will not be properly positioned and the lens may need to be scrapped.

The lens blank may be adhesively secured to a circular device known as a block. The circular block may be plastic or some other material, and provides structure which the edging machine may grasp in order for the lens blank to be rotated. Various blocks are known in the art, as are various means for securing the blocks to the lens blank. One well-known blocking system is the 3M® adhesive blocker to which a circular brass block is applied.

Various devices are known in the art for assuring that the block is positioned on the geometric center of the frame shape cut-out. These devices typically require some manual manipulation by the lens maker, thereby potentially introducing human error into the positioning process. Furthermore, prior blockers introduce parallax error on account of the curvature of the lens surfaces, thereby creating another potential error. The manner in which the adhesive block is placed into contact with the lens also provides a potential for error.

Those skilled in the art will understand that there is a need for a lens blocker which assures proper positioning of the geometric center relative to the optical center in a manner which minimizes or eliminates the above potential positioning errors. The disclosed invention is one which meets those needs and avoids those errors because the optical center is positioned on a table system positionable in two axes relative to a fixed position block applicator. A computer control system calculates the geometric center and the displacements relative to the optical center, and outputs motor control signals in response thereto with the result that precise control over movement of the table system is provided.

OBJECTS AND SUMMARY OF THE INVENTION

It is a primary object of the disclosed invention to provide an optical lens blocker which automatically moves a lens blank with two degrees of freedom in order to position the geometric center relative to the optical center.

Another object of the invention is a method for causing an optical lens blank to be displaced with two degrees of freedom relative to a fixed position block applicator so that the geometric center is properly positioned relative to the optical center.

A lens blocker assembly, according to the invention, comprises a first support moveable in a first direction. A second support is carried by the first support and is moveable in a second direction, the second direction being angularly disposed relative to the first direction. Means are operably associated with the supports for selectively moving the supports in the associated directions. A lens block applicator is operably associated with the second support for applying a lens block to a lens blank disposed on the second support.

A lens blocker comprises a base, with at least a first rod extending vertically from the base. A housing is slidably mounted to the rod and is adapted for movement thereon. An arm has proximal and distal portions, the proximal portion being pivotally connected to the housing for permitting the arm to pivot between a first angularly disposed position and a second horizontal position. A sight piece is secured to the distal portion and is pivotal therewith. The sight piece is aligned to the final center position of the block when placed on the lens. An applicator is secured to the distal portion and is pivotal therewith for applying a block to a lens. A stop is secured to the housing and is engageable by the arm for positioning the arm in the second position, so that further application of force to the arm causes vertical displacement of the housing and thereby of the arm to a third position wherein the applicator may apply the block to the lens.

A lens blocker assembly comprises a base, with a first table carried by the base and moveable in a first direction. A second table is carried by the first table and is moveable in a second direction transverse to the first direction. First and second drives are provided, and each of the drives is operably associated with one of the tables for causing associated movement thereof. A lens blocker includes an applicator portion operably associated with the second table for applying a block to a lens blank carried by the second table. Control means are operably associated with each of the drives for causing selective operation thereof, so that a lens blank positioned on the second table is properly positioned relative to the applicator portion.

The method of blocking a lens comprises the steps of providing first and second cooperating superposed tables, with each table moveable relative to the other. A lens blocker is provided adjacent the second table. A lens blank is positioned on the second table, and the first and second tables are then selectively moved so that the blank assumes a desired position relative to the blocker. The blocker then applies a block to the lens blank.

These and other objects and advantages and novel features of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE PREFERRED EMBODIMENT

Figure 1:
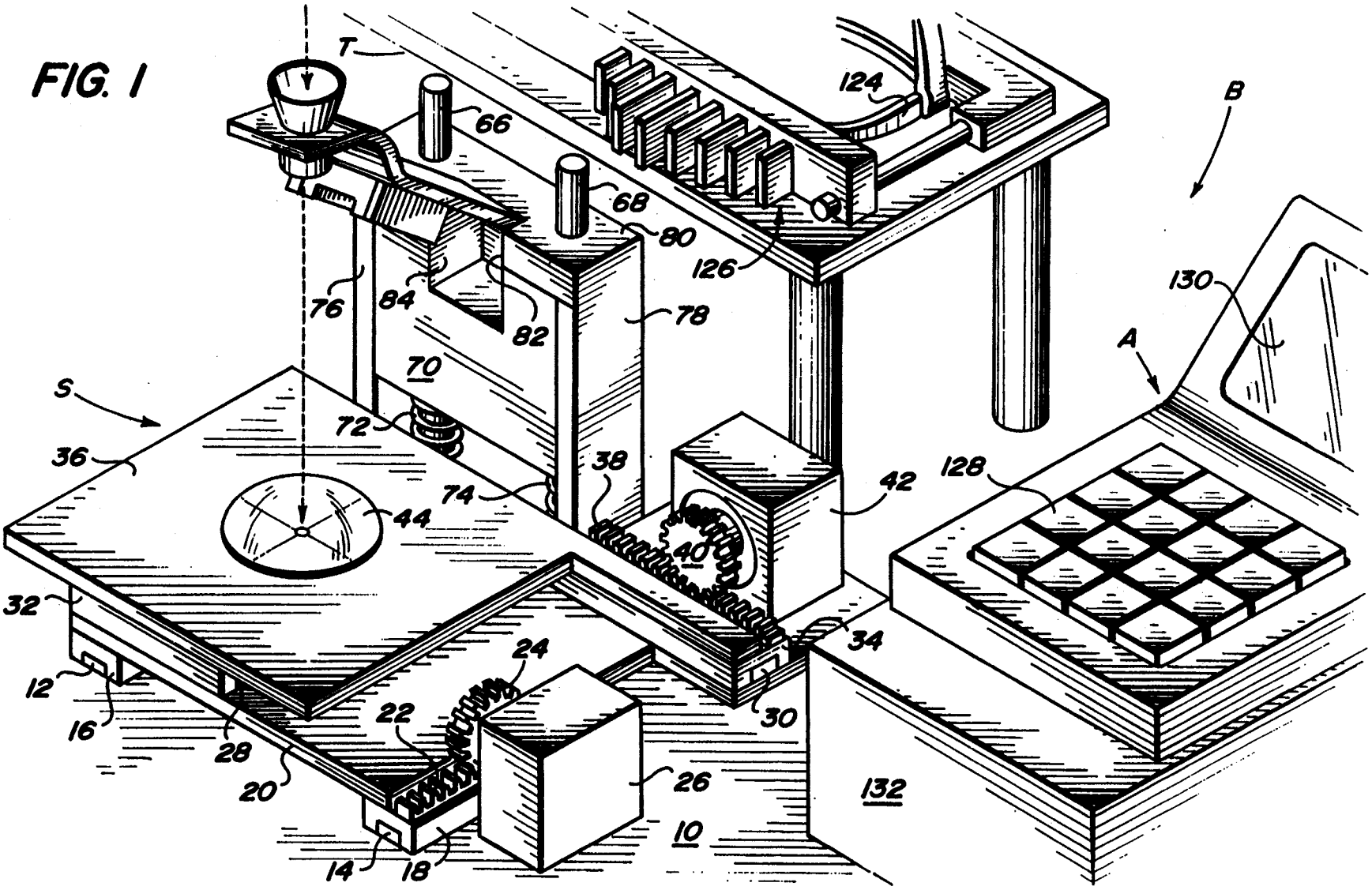
FIG. 1 is a fragmentary perspective view of the lens blocker assembly of the invention.

Lens blocker B, as best shown in FIG. 1, includes a tracer assembly T, a block applying system S, and a data input and display control assembly A. The tracer assembly T may be any one of a number of commercially available tracers, such as a National Optronics Saturn I.

Blocker B, as best shown in FIG. 1, includes a base 10, which preferably is rectangular in plan. Base 10 provides a support for the assemblies listed above, and is sufficiently heavy to minimize vibrational effects without being too heavy to prevent the blocker B from being suitable for mounting on a table top or the like. Ways 12 and 14 are positioned on base 10 in parallel alignment, and are secured thereto by means well-known in the art. Way covers 16 and 18 are slidably mounted to the ways 12 and 14, respectively, and the way covers 16 and 18 are longitudinally slidable therealong. First support table 20 is secured to the way covers 16 and 18 and is moveable therewith in response to movement of the way covers 16 and 18. Geared rack 22 is secured to the table 20 and thereby to the way cover 18. Geared rack 22 is in parallel alignment with the ways 12 and 14. Pinion 24 is secured to the rotatable shaft of stepper motor 26. The teeth of the pinion 24 are meshingly engaged with the teeth of geared rack 22, so that operation of the stepper motor 26 causes rotation of the pinion 24 and thereby longitudinal displacement of the geared rack 22 and thus of the table 20.

Ways 28 and 30 are secured to table 20 in parallel alignment. The ways 28 and 30 are disposed transverse to the ways 12 and 14. Way covers 32 and 34 are moveable along the ways 28 and 30, respectively, just as the way covers 16 and 18 are moveable along the ways 12 and 14.

Second support table 36 is secured to way covers 32 and 34. Second table 36 is planar, and is disposed parallel to planar first table 20. Geared rack 38 is secured to second table 36 and hence to way cover 34. Pinion 40 is secured to the rotatable shaft of stepper motor 42. The teeth of pinion 40 are meshingly engaged with the teeth of geared rack 38, so that operation of stepper motor 42 causes associated movement of the table 36 along the ways 28 and 30. The stepper motor 42 is secured to the table 20 and therefore is moveable therewith.

Those skilled in the art will understand that the tables 20 and 36 are moveable with two degrees of freedom, and define a two-axis system. Because of the control provided by the stepper motors 26 and 42, an object, such as lens blank 44, may be positioned anywhere within the area accessed by virtue of movement of the tables 20 and 36 in response to operation of the motors 26 and 42. While I have disclosed the use of stepper motors for causing associated movement of the tables 20 and 36, those skilled in the art will understand that there are other sorts of variable output drive mechanisms, such as servo motors having ball nuts and screws, which could be used for causing controlled movement of the tables 20 and 36 and which would not require use of the geared racks.

Figure 7:
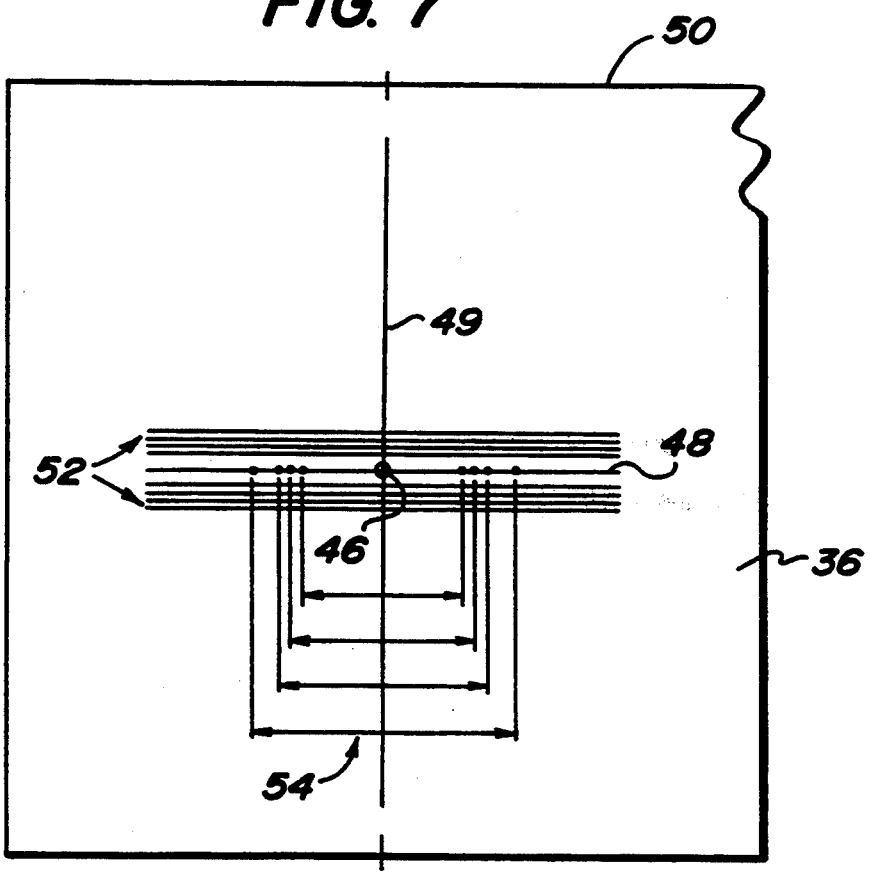
FIG. 7 is a fragmentary top plan view of the lens blank support table.

Table 36, as best shown in FIG. 7, has an aperture 46 extending therethrough. Aperture 46 provides a center target for alignment of the lens 44, when the lens 44 is to be placed upon the table 36 for blocking. Table 36 also has a first marking line 48 which extends through aperture 46 and parallel to rear edge 50, and a transverse line 49 for thereby providing a cross-hair. Indicia 52, comprising a series of lines disposed parallel to and on either side of center line 48, are positioned upon the top surface of table 36 to ensure accuracy in positioning and alignment of the blank 44. Similarly, indicia 54, comprising a series of lines extending transverse to line 48, which lines intersect with line 48, likewise are to be used in properly positioning lens blank 44.

Figure 2:
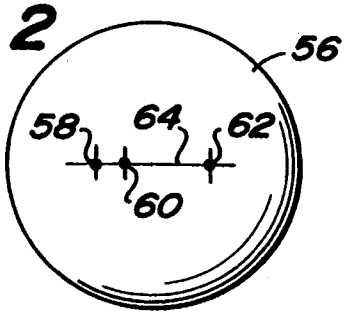
FIG. 2 is a top plan view of a lens blank prior to being edged.

Lens blank 56, which corresponds to the lens blank 44 of FIG. 1, is best shown in FIG. 2. Lens blank 56 has had the rear surface generated, and marking dots 58, 60, and 62 have been placed on the lens blank 56. Axis line 64, which extends through the dots 58–62, has also been placed on blank 56. Those skilled in the art will understand that the marking dot 60 has been placed thereon by the lens maker and identifies the optical center of the blank 56. The marking dots 58 and 62 permit the axis line 64 to be drawn, which axis line identifies the optical axis of the blank. The marking dot 60 is, preferably, essentially the same size as the diameter of the aperture 46, so that placing the blank 56 on the table 36 so that the marking dot 60 masks the aperture 46 will permit the lens maker to be assured that the optical center has been properly positioned upon the table 36. Similarly, axis line 64 is then aligned with the center line 48 to make sure that proper orientation is achieved.

Rods 66 and 68 are secured to and extend vertically in spaced parallel relation from base 10, as best shown in FIG. 1. Housing 70 is mounted to the rods 66 and 68 and is vertically moveable thereon. Coil springs 72 and 74 are mounted about the rods 66 and 68, respectively, and are disposed between the housing 70 and the base 10 for biasing the housing 70 into its vertically upwardly disposed position.

Vertical supports 76 and 78 are positioned adjacent either side of housing 70. Cap 80 extends between the supports 76 and 78, and has aligned apertures through which the rods 66 and 68 extend. It can be seen in FIGS. 3–5 that cap 80 has a U-shaped cut-out portion 82. Housing 70, on the other hand, has a U-shaped cutout portion 84 aligned with the cut-out portion 82 of cap 80. Upper edge 86 of housing 70 may engage the lower surface of cap 80 in response to extension of the springs 72 and 74, thereby limiting the displacement of the housing 70 on the rods 66 and 68.

Pin 88 extends between the opposite side walls of the cut-out portion 84 of housing 70. Arm 90 has a proximal portion 92 which is mounted to pin 88 for pivotal rotation thereabout in response to the application of force by the lens maker. Proximal portion 92 has an edge 94 which, as best shown in FIG. 4, engages the lower surface 96 of cut-out portion 84 in order to prevent the arm 90 from pivoting about pin 88 by more than a preselected amount.

Figure 5:
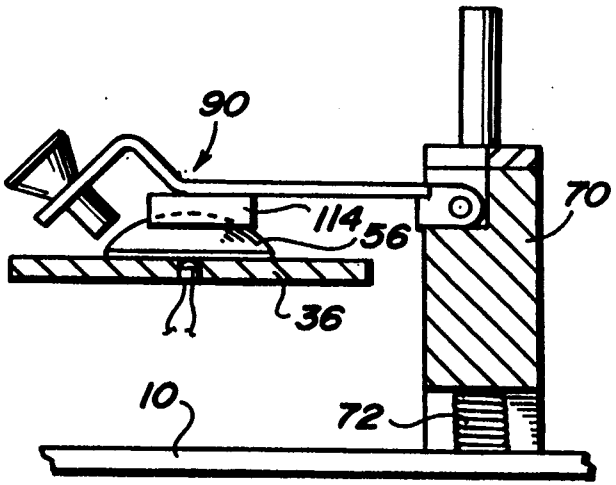
FIG. 5 is a fragmentary elevational view, partially in section, of the lens block applicator of FIGS. 3 and 4 in a third position.
Figure 4:
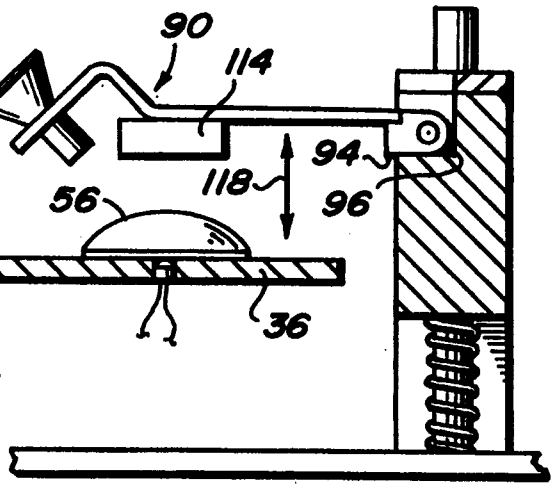
FIG. 4 is a fragmentary elevational view, partially in section, of the lens block applicator of FIG. 3 in a second position.
Figure 3:
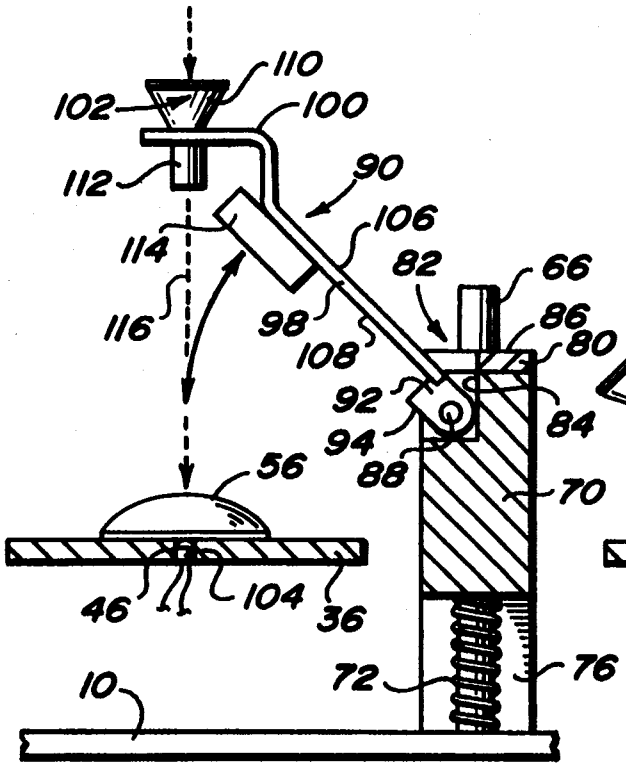
FIG. 3 is a fragmentary side elevational view, partially in section, illustrating the lens block applicator in a first position.

It can be seen in FIGS. 3–5 that arm 90 has a first portion 98 extending from proximal portion 92, with a generally L-shaped distal portion 100 remote therefrom. Sight piece 102 provides a viewing system by which the user may ascertain that the marking dot 60 of the lens blank 56 is properly aligned with aperture 46 in table 36. Sight piece 102 permits the user to look therethrough, much like through a jeweler's loop or a microscope, in order to ascertain that the marking dot 60 is centered over the aperture 46. In order to facilitate this alignment, I provide a light emitting diode ("LED") 104 within the aperture 46. The LED 104 is the same size as the marking dot 60, so that the user, by masking the light emanating from the marking dot 60, can be assured of proper positioning of the optical center defined by the marking dot 60.

One difficulty experienced with prior blockers has been the problem of parallax error. Parallax error, as known to those skilled in the art, arises because of the index of refraction of the lens blank material, which causes the image to be somewhat angularly disposed relative to the direction of sight. Because the sight piece 102 assures that the user is looking vertically down through the marking dot 60, then parallax error is eliminated.

Arm 90, as best shown in FIGS. 3–5, has a first surface 106 and a second, or lower, surface 108. The sight piece 102 has a cone-shaped portion 110 extending beyond first surface 106, and a tubular portion 112 extending beyond lower surface 108. Also attached to lower surface 106, preferably at the knee between the L-shaped portion 100 and the straight portion 98, is the block applicator 114. Block applicator 114 is of conventional design, and provides a surface for the adhesive block to be applied to the blank 56.

It can be seen in FIG. 3 that the arm 90 is angularly disposed relative to the vertical axis defined by the rods 66 and 68, with the result that the sight piece 102 looks vertically downwardly onto the blank 56 as indicated by the arrow 116. After the user has assured that the marking dot 60 for the optical center of blank 56 is properly aligned with the LED 104 and that the axis line 64 is aligned with the center line 48 of table 36, then the user, after entering the data for proper layout prompts the machine which positions the two axes table with the lens to the proper position, need merely press downwardly onto the arm 90 in order to cause the arm 90 to pivot about the pin 88 from its first, or angularly, disposed position to the second or horizontally disposed position wherein the edge 94 engages the surface 96, as best shown in FIG. 4. Because the surface 96 acts as a stop for the edge 94, then I assure that the arm 90 is disposed in the horizontal position parallel to table 36. Additional pressure on the arm 90 causes the housing 70 to move vertically downwardly on the rods 66 and 68, as shown by the double arrow 118, until the applicator 114 engages the blank 56 and places the adhesive block thereon, as best shown in FIG. 5. This vertical movement minimizes error in block positioning as arose in prior applications using a pivotal arm. Also, because the center of applicator 114 is aligned with the sighting axis 116 of sight piece 102, then I assure that the optical center will be accurately moved relative to the geometric center on which the block is applied.

Pivoting the arm 90 from the angular position of FIG. 3 to the horizontal position of FIG. 4, and finally to the vertically displaced third position of FIG. 5 is easily accomplished because the L-shaped portion 100 of arm 90 acts as a handle. It can be noted in FIG. 5, that the coil spring 72 has been compressed by the downwardly directed vertical displacement of the housing 70. Once the user releases the force holding the arm 90 in the downward position, then the coil springs 72 and 74 move the housing 70 vertically upwardly. The arm 90 is, of course, then able to be pivoted into the angular position of FIG. 3, thereby ready to block another lens.

Figure 9:
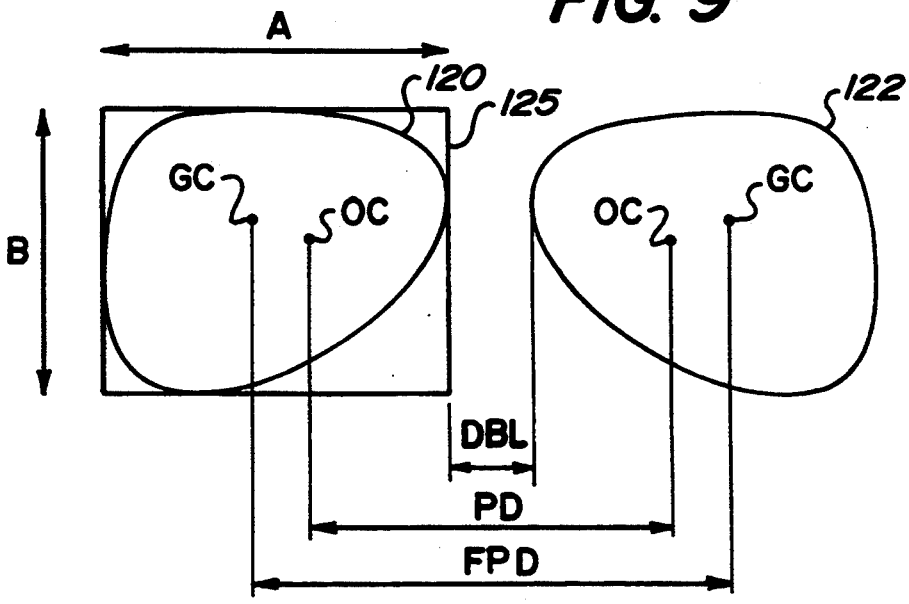
FIG. 9 is a schematic view illustrating a pair of edged lenses as they would be positioned in a frame, with one of the lenses being boxed for definition of the geometric center.

FIG. 9 discloses edged lenses 120 and 122 as they would be positioned within a frame, such as the frame 124 of FIG. 1. Marked on each of the lenses of FIG. 9 is the optical center OC, as well as the geometric center GC. As noted earlier, the geometric center is the axis about which the lens rotates during the edging process and is defined by the intersection of the A and B distances as shown for box 125, and its position is a function of the configuration of the lens. The optical center, on the other hand, is that point of the lens which is aligned with the pupil of the wearer, and thus the optical center is directly related to the pupillary spacing between the eyes of the user. FIG. 9 has a double arrow noting the pupillary distance or "PD" between the optical centers of the lenses 120 and 122, as well as a further double line noting the frame distance "FPD" between the geometric centers of the lenses 120 and 122. Another distance which needs to be taken into account for assuring proper alignment of the optical and geometric centers is the distance between lenses or "DBL" which is similarly indicated by a double line in FIG. 9. The distance between lenses is the distance between the closest portions of the lenses, and frequently approximates the width of the nose piece.

Because the pupillary distance is known, then the lens maker must determine the frame distance and the distance between lenses prior to beginning the edging process and prior to applying the block. Tracer assembly T of FIG. 1 discloses that the eyeglass frame 124, only a portion of which is shown, is clamped within clamping assembly 126. Tracer assembly T has a contact wheel or point which engages and traverses the frame within the openings into which the finished lenses are to be placed, and determines the size and shape of each opening. The tracer assembly T furthermore permits the distance between lenses to be determined. Once the shape data has been measured in the tracer assembly T, then the data is forwarded to the control assembly A of FIG. 1.

Figure 8:
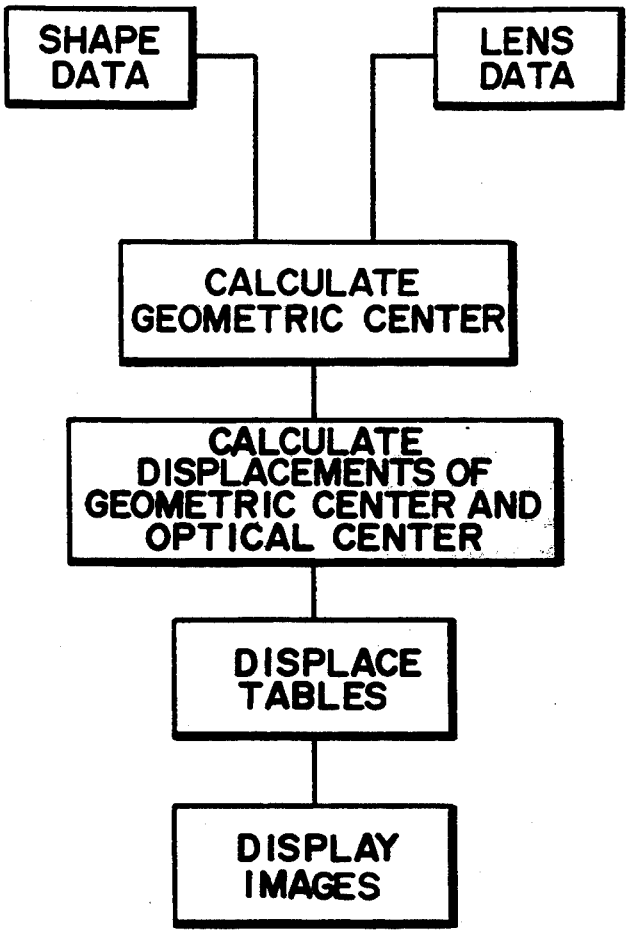
FIG. 8 is a schematic diagram of the control system of the invention.

The control assembly A includes a computer keyboard 128 and a video display 130. Control assembly A preferably is mounted upon a housing 132 within which the computer controls, microprocessors, and related control equipment are housed. FIG. 8 is a schematic diagram illustrating the steps which the control assembly A performs in the course of creating the drive signals for the stepper motors 26 and 42. Those skilled in the art will appreciate that the tracer assembly T is in computer communication with the control assembly A, and that the control assembly A likewise is in communication with each of the stepper motors 26 and 42 for controlling operation thereof.

The lens maker first places the lens blank 56 onto table 36, with dot 60 masking LED 104 and axis 64 aligned with center line 48. The tables 20 and 36 are in a known start position, with LED 104 aligned with sighting axis 116. Then, as indicated in FIG. 8, the shape data and lens data are input to the computer control assembly A either directly from tracer T or through the aid of keyboard 128. The geometric center is then calculated. Once the geometric center is known, then the computer calculates the displacement in two axes between the position of the optical center and the position of the geometric center. After the computer has calculated the offsets between the geometric center relative to the optical center, then the tables 20 and 36 are displaced by operation of the stepper motors 26 and 42 in order to position the geometric center in proper position for application of a block by the block applicator 114, as best shown in FIG. 5. The block may then be applied.

Figure 6:
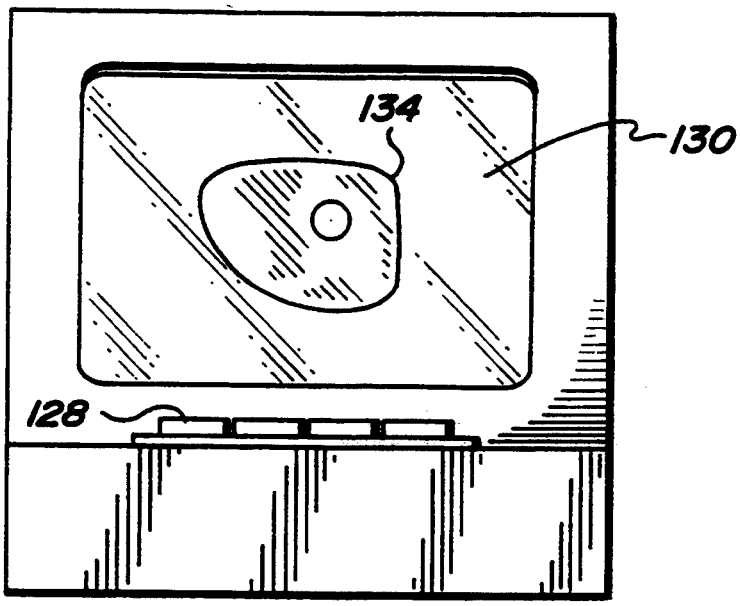
FIG. 6 is a front elevational view of the computer display of the invention.

After the tables 20 and 36 have been displaced, then the computer control assembly A displays a full scale image on the video display 130 of the to be created lens and the position of the block. FIG. 6 discloses the full scale image of edged lens 134, as well as a full scale image of block 136. Because the images 134 and 136 are full scale, then the lens maker may take the now blocked lens 56 and align the block with the image 136 in order to make certain that the image 134 fits within the periphery of the blank 56. Should some portion of image 134 extend beyond the periphery of block 56, then either the blank is too small or the block not properly positioned. In this way, the lens maker may be assured that the lens blank 56 is the proper size for being edged by the edger into the finished lens.

The disclosed invention, because of the two-axis coordinate system provided by the tables 20 and 36 and because of the computer control assembly A, eliminates the need for the lens maker to move and align the lens by hand while looking at a grid at some angle to the vertical. The operator need not read the layout data in order to reposition some alignment grid. The computer control assembly A, because the shape data and the lens data are input through a display, a keyboard, and the tracer assembly T, may automatically position the table 36 both horizontally and vertically, that is in the X–Y directions, in order to properly position the lens 56 for blocking.

While this invention has been described as having a preferred design, it is understood that it is capable of further modifications, uses, and/or adaptations of the invention following the general principle of the invention and including such departures from the present disclosure has come within the known or customary practice in the art to which the invention pertains and as may be applied to the central features hereinbefore set forth, and falls within the scope of the invention and of the limits of the appended claims.

What I claim is:

1. A lens blocker assembly, comprising:

a) a first support movable in a first direction;

b) a second support carried by said first support and movable in a second direction, said second direction angularly disposed relative to said first direction;

c) first and second variable output motors, each motor operably associated with one of said supports for selectively moving the associated support in the associated direction; and d) a lens block applicator operably associated with said second support for applying a lens block to a lens blank disposed on said second support.

2. The assembly of claim 1, wherein:

a) said first direction is transverse to said second direction.

3. The assembly of claim 2, wherein:

a) a sighting assembly is carried by said applicator and is aligned with a preselected target on said second support; and b) said target is light emitting.

4. The assembly of claim 2, wherein:

a) said moving means moves said supports toward said lens block applicator.

5. The assembly of claim 2, wherein:

a) at least one of said motors is a stepper motor.

6. The assembly of claim 1, wherein:

a) each of said motors has an output shaft extending transverse to the associated direction.

7. The assembly of claim 1, wherein said moving means includes:

a) first and second racks, and cooperating first and second pinions; and b) each of said racks is associated with one of said supports and each of said pinions is associated with one of said motors.

8. The assembly of claim 1, wherein:

a) said block applicator includes an applicator portion pivotal between a first orientation angularly disposed relative to said second support and a second orientation disposed parallel thereto.

9. The assembly of claim 8, wherein:

a) said block applicator and said portion are vertically moveable between said second orientation and a third orientation in which said applicator portion may engage a lens blank and apply a block thereto.

10. The assembly of claim 9, wherein:

a) resilient means are operably associated with said block applicator for biasing said applicator towards said second orientation.

11. The assembly of claim 9, further comprising:

a) a sighting assembly carried by said applicator portion and aligned with a preselected target on said second support.

12. The assembly of claim 11, wherein:

a) said target is light emitting.

13. The assembly of claim 1, wherein:

a) said moving means includes a computer system for receiving data associated with the movement to be given to said supports by said motors.

14. The assembly of claim 13, further comprising:

a) a frame tracer assembly operably associated with said computer for supplying shape data thereto concerning the lens blank.

15. A lens blocker assembly, comprising:

a) a base;

b) a first table carried by said base and moveable in a first direction;

c) a second table carried by said first table and moveable in a second direction transverse to said first direction;

d) first and second drives, each of said drives operably associated with one of said tables for causing associated movement thereof;

e) a lens blocker including an applicator portion operably associated with said second table for applying a block to a lens blank carried by said second table; and f) control means operably associated with each of said drives for causing selective operation thereof so that a lens blank positioned on said second table is properly positioned relative to said applicator portion.

16. The assembly of claim 15, wherein:

a) said applicator portion is pivotal between a first angularly disposed position and a second position disposed parallel to said second table.

17. The assembly of claim 16, wherein:

a) said applicator portion is vertically displaceable between said second position and a third position wherein said portion may contact a lens blank and apply a block thereto.

18. The assembly of claim 17, wherein:

a) resilient means bias said portion to said second position.

19. The assembly of claim 16, wherein:

a) a plurality of indicia are disposed on said second table for permitting selective positioning of a lens blank thereon.

20. The assembly of claim 19, wherein:

a) a sight piece is carried by said portion and, when in said first position, is aligned with a selected one of said indicia.

21. The assembly of claim 15, wherein:

a) light emitting means are operably associated with said second table and are carried thereby for permitting selective positioning of a lens blank thereon.

22. The assembly of claim 21, wherein:

a) said light emitting means includes a light emitting diode.

23. The assembly of claim 22, wherein:

a) an aperture extends through said second table, and said light emitting diode is positioned in said aperture.

24. The assembly of claim 15, wherein:

a) said first drive is secured to said base and is operably associated with said first table; and b) said second drive is secured to said first table and is moveable therewith, and is operably associated with said second table.

25. The assembly of claim 24, wherein each of said drives includes:

a) a variable output motor, a pinion, and a rack;

b) each rack is secured to an associated one of said tables; and c) each pinion is drivingly engaged with an associated one of said motors and is meshingly engaged with an associated rack so that operation of the motor causes associated movement of the rack.

26. The assembly of claim 25, wherein:

a) said second pinion rotates about an axis extending parallel to said first direction; and b) said first pinion rotates about an axis extending parallel to said second direction.

27. The assembly of claim 15, wherein said control means includes:

a) a computer for receiving data associated with the movement which each table is to receive; and b) a frame tracer assembly for permitting shape data to be supplied thereto.

28. The assembly of claim 27, wherein:

a) a video display is operably associated with said computer for displaying an image of the finished lens in response to receipt of shape data.

* * * * *